US006401511B1

(12) United States Patent
Leng

(10) Patent No.: US 6,401,511 B1
(45) Date of Patent: Jun. 11, 2002

(54) METHOD FOR MANUFACTURING METAL MATERIAL WITH AN INTERMEDIATE HOLLOW AND TWO SOLID END PORTIONS

(76) Inventor: Tony Leng, No. 68, Lane 60, Guang Ming South Road, Nan Tou City, Nan Tou Hsien (TW)

( * ) Notice: Subject to any disclaimer, the term of this patent is extended or adjusted under 35 U.S.C. 154(b) by 0 days.

(21) Appl. No.: 09/684,778

(22) Filed: Oct. 10, 2000

(51) Int. Cl.[7] ..... B21K 21/14
(52) U.S. Cl. ..... 72/356; 72/377
(58) Field of Search ..... 29/888.451, 888.452; 72/356, 370.12, 377

(56) References Cited

U.S. PATENT DOCUMENTS 2,392,175 A * 1/1946 Norton ..... 29/888.452
2,748,464 A * 6/1956 Kaul ..... 72/356

* cited by examiner

*Primary Examiner*—Lowell A. Larson
(74) *Attorney, Agent, or Firm*—Troxell Law Office PLLC

(57) ABSTRACT

The method for manufacturing a metal material with an intermediate hollow and two solid end portions includes a step for preparing a first mold for manufacturing a roughly-shaped metal material with a first inner solid end hollow and a lengthwise intermediate hollow of a preset length. A conical portion is formed around am outer end hole of the mold. The outer conical end of the metal material is pressed in the intermediate hollow to form a second outer end portion of the metal material. Thus, a finished product of metal material with two solid end portions and an intermediate hollow is manufactured. Such a method can surely simplify the processes of manufacture, lowing the cost of production, and strengthening the integrated structure of products.

5 Claims, 8 Drawing Sheets

METHOD FOR MANUFACTURING METAL MATERIAL WITH AN INTERMEDIATE HOLLOW AND TWO SOLID END PORTIONS

BACKGROUND OF THE INVENTION

This invention relates to a method for manufacturing metal material with an intermediate hollow and two solid end portions, particularly to one possible to simplify manufacture processes, to lower the cost of production and to strengthen the structure of products.

A conventional method for manufacturing a bike crank includes a step for preparing a sand-core embedded in an intermediate hollow in a mold of a crank. Then melted material is filled in the mold, and when the roughly shaped crank is to be taken out, an opening in the end section of the crank is bored for removing the sand core out of the mold. Then, the outer surface of the crank is ground smooth to finish the crank with the intermediate hollow. Such a method for manufacturing the crank is not only complicated in processes, but also increases the cost of production. Besides, boring an opening or a threaded hole for removing the sand core in the crank will weaken its strength.

Another conventional method for manufacturing a crank with an intermediate hollow is to preset a slot in one side surface of a crank body, which is to be closed up with a cover means welded together with the rim of the slot. Such structure of a crank is not integrated as one unit, weakened in its strength, and due to the varied materials of the crank and the cover means as well as possibility of expansion and contraction caused by weather, so the joint section may be liable to split.

SUMMARY OF THE INVENTION

The objective of the invention is to offer a method for manufacturing metal material with an intermediate hollow and two solid end portions. A first step of the method is to prepare a roughly-shaped metal material having a first inner solid end portion, and a bar body having a lengthwise intermediate hollow, and an expanded conical portion set around an open end hole of the bar body. Next, the expanded conical portion is compressed and shrunk to move towards the open end hole of the bar body and closes it up, forming a second solid end portion; then, the intermediate hollow is closed up by the second solid end portion, and a finished crank of metal material with an intermediate hollow and two solid end portions is obtained.

Another objective of the invention is to offer a method for manufacturing metal material with an intermediate hollow and two solid end portions, which is simple in manufacture, quick in shaping, integral as one unit and sure to strengthen the structure of metal material.

BRIEF DESCRIPTION OF DRAWINGS

This invention will be better understood by referring to the accompanying drawings.

DETAILED DESCRIPTION OF THE PREFERRED EMBODIMENTS

Figure 1:
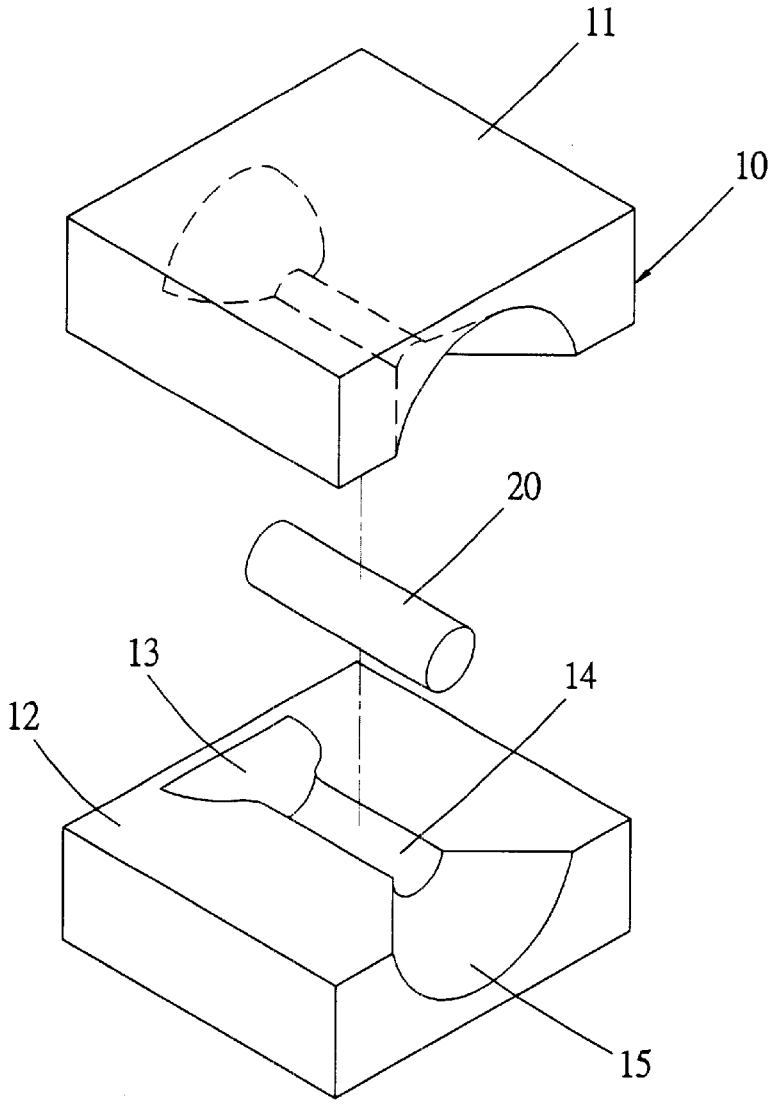
FIG. 1 is an exploded perspective view of a first preferred embodiment of a method for manufacturing metal material with an intermediate hollow and two solid end portions, wherein a metal bar material is to be placed in a mold in the present invention.

A first embodiment of a method for manufacturing metal material with an intermediate hollow and two solid end portions in the present invention, as shown in FIG. 1, includes a mold 10 for making a roughly-shaped metal material, consisting of an upper mold 11 and a lower mold 12. After combined together, the mold 10 forms an inner semispherical end hollow 13, an intermediate cylindrical hollow 14 communicating with the inner end hollow 13. The cylindrical hollow 14 connects with an outer conical open-end hole 15. Further, the inner end hollow 13 has a larger diameter than that of the intermediate cylindrical hollow 14, and may have a rectangular, spherical, conical shape or the like.

Further, a metal bar material 20 of a cylindrical solid aluminum alloy is placed in the intermediate cylindrical hollow 14 of the mold 10, then the upper mold 11 and the lower mold 12 are combined together.

Figure 2A:
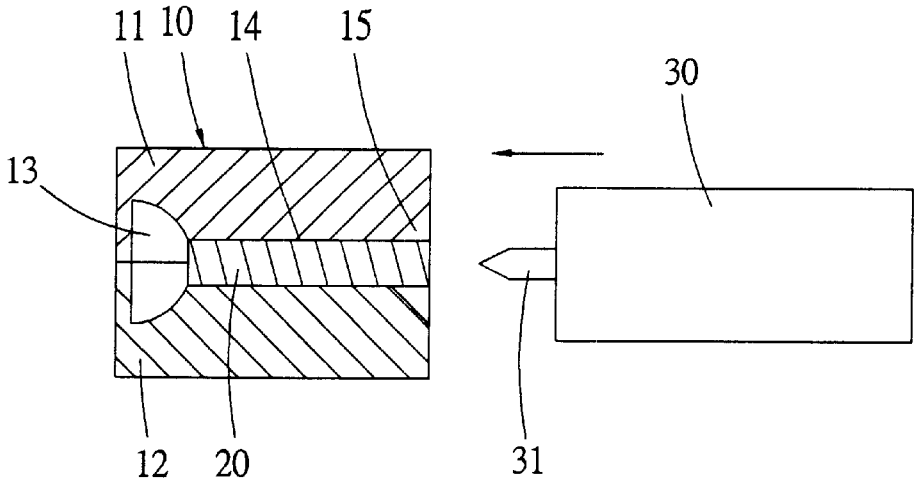
FIG. 2(A) is a side cross-sectional view of the first preferred embodiment of the method, wherein the metal bar material placed in the mold is not yet pressed into shape in the present invention.
Figure 2B:
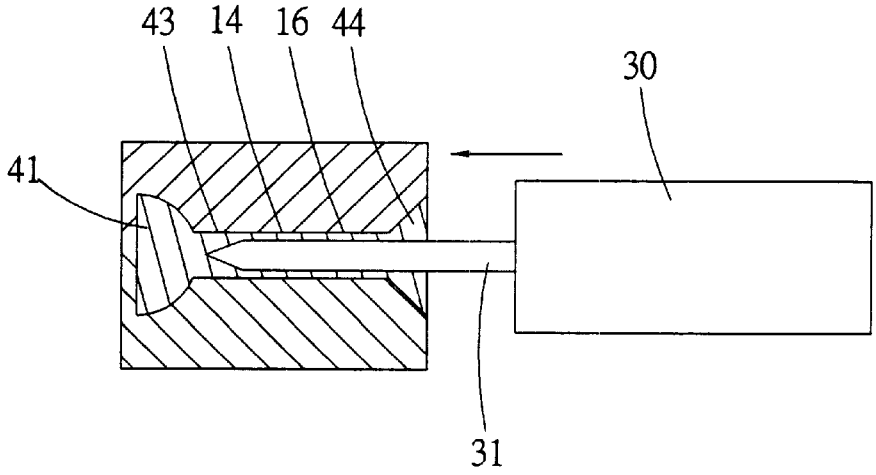
FIG. 2(B) if is a side cross-sectional view of the first preferred embodiment of the method, wherein the metal bar material is ready shaped in the present invention.

Next, as shown in FIG. 2(A), the metal bar material 20 placed in the intermediate hollow 14 of the mold 10 is pressed into shape by means of a press device 30 having a press rod 31, which is actuated to rectilinearly press the outer end of the metal bar material 20. The outer diameter of the press rod 31 of a preset length is smaller than the inner diameter of the intermediate cylindrical hollow 14 in order to form an annular gap 16 of a preset size between the outer surface of the press rod 31 and the inner wall of the intermediate cylindrical hollow 14. The press rod 31 presses the metal bar material 20 through the conical hole 15 of the mold 10, and after a preset time, as shown in FIG. 2(B), the metal bar material 20 is pressed by the press rod 31 to reach the bottom of the inner semi-spherical hole 13 and filling it up. In addition, due to continual pressing by the press rod 31, surplus of the metal bar material 20 is pushed along the press rod 31 filling up the annular gap 16 of the intermediate cylindrical hollow 14 and the conical hole 15 of the mold 10.

In accordance with the first preferred embodiment, the press rod 31 has the largest stroke as to press the solid metal bar material 20 to fill up the whole intermediate cylindrical hollow 13, pushing it to extend along the annular gap 16 outward to a required length. Then, the press rod 31 is pulled out of the mold 10, the upper mold 11 is opened, and thus a roughly shaped metal material 40 is acquired.

Figure 3:
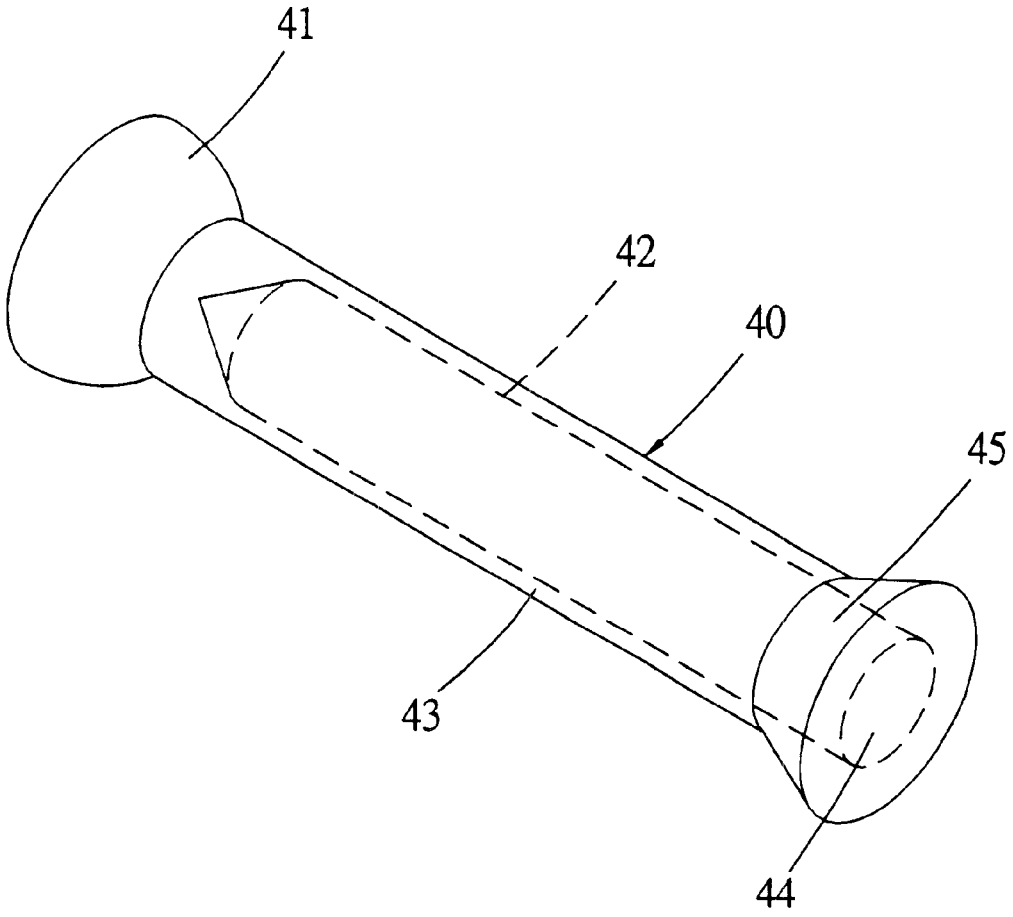
FIG. 3 is a perspective view of the metal bar material roughly shaped in the present invention.

Furthermore, as shown in FIG. 3, the roughly-shaped metal material 40 has a first solid end portion 41 formed in the inner semi-spherical hole 13 and a bar body 43 connected with the first solid end portion 41 has a lengthwise hollow 42 of a preset length formed by the press rod 31 pulled out. The bar body 43 has an integral circumferential wall, and the wall is formed by the annular gap 16. In addition, the bar body 43 has an outer open hole 44 with an expanded conical portion 45 of a preset size, and the expanded conical portion 45 is formed by the conical hole 15 of the mold 10.

Figure 4A:
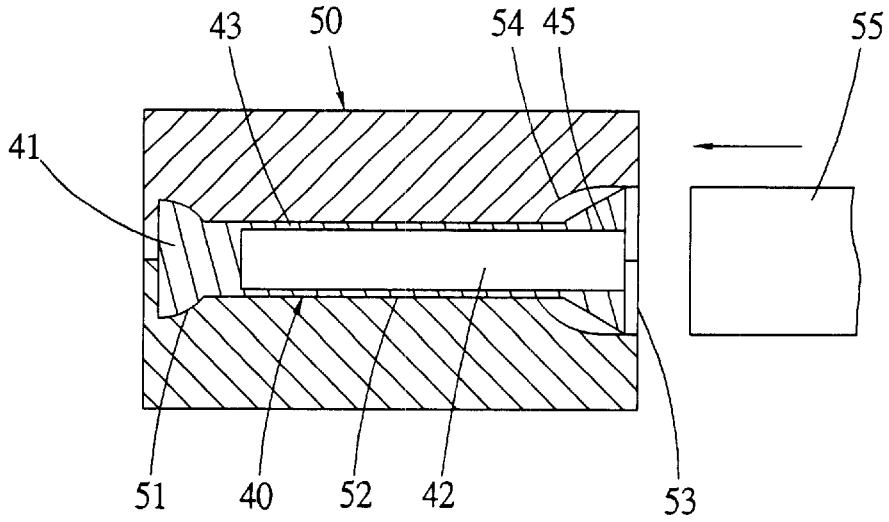
FIG. 4(A) is a side cross-sectional view of the first preferred embodiment of the method, wherein the roughly-shaped metal bar material placed in a closed mold in the present invention.
Figure 4B:
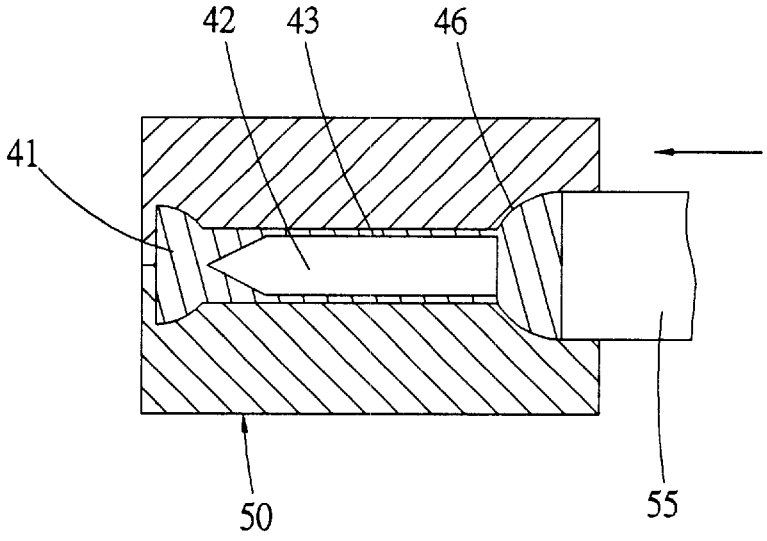
FIG. 4(B) is a side cross-sectional view of the first preferred embodiment of the method, wherein the roughly-shaped metal bar material placed in the mold and pressed to be shaped in the present invention.
Figure 5:
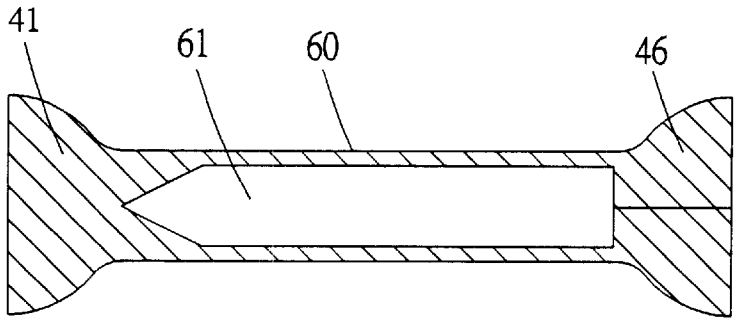
FIG. 5 is a cross-sectional view of the metal material roughly shaped in the first preferred embodiment in the present invention.
Figure 6:
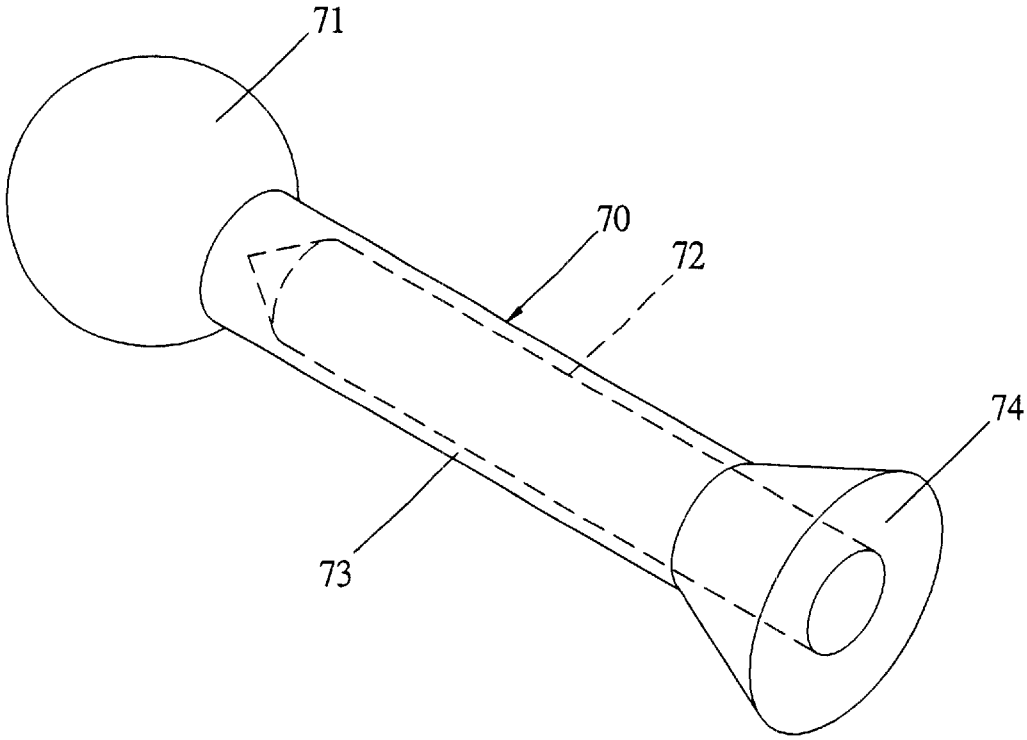
FIG. 6 is a perspective view of the metal bar material roughly shaped in a second preferred embodiment of the method in the present invention.

Next, as shown in FIG. 4(A), the expanded conical portion 45 is then closed up, forming a second solid end portion 46; then, the roughly-shaped metal material 40 is placed in a closed mold 50 formed of an upper mold and a lower mold combined together with an inner semi-spherical hollow 51, an intermediate cylindrical hollow 52 communicating with the inner hollow 51. And an outer open hole 53 is formed to communicating with the intermediate cylindrical hollow 52, having a semicircular molding wall 54. Then, the expanded conical portion 45 of the roughly-shaped metal material 40 is pressed by means of a press rod 55, as shown in FIG. 4(B), and pushed to extend towards the outer open hole 53 and then closed up the molding wall 54, forming a second solid end portion 46, as shown in FIG. 5. Thus, a finished product of a dumbbell-shaped metal material with an intermediate hollow and two solid end portions is obtained.

Figure 7A:
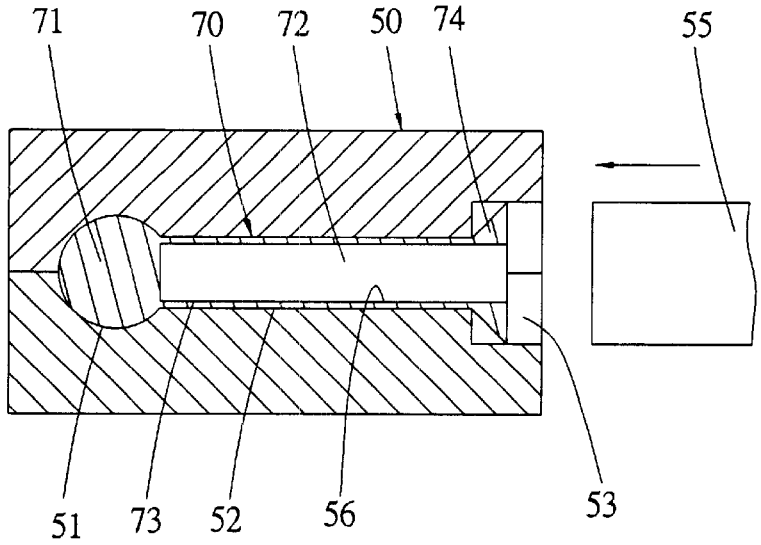
FIG. 7(A) is a cross-sectional view of the roughly-shaped metal bar material placed in a closed mold in the second preferred embodiment in the present invention.
Figure 7B:
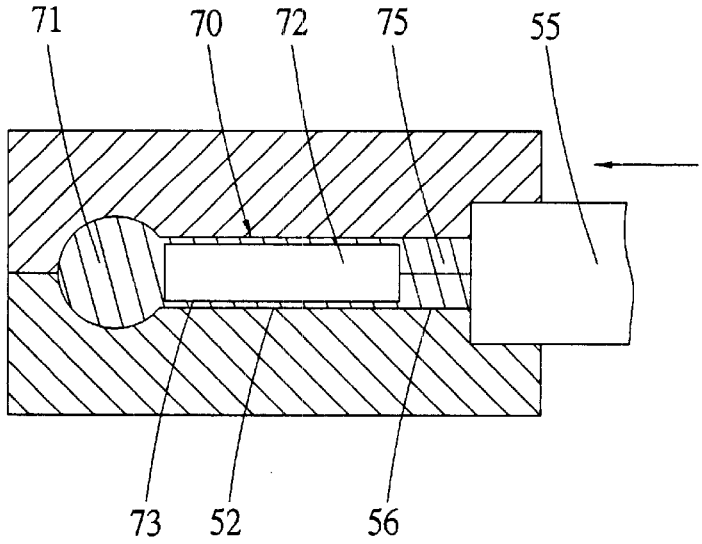
FIG. 7(B) is a side cross-sectional view of the roughly-shaped metal bar material placed in the mold and pressed by a press rod to shape in the second preferred embodiment in the present invention.
Figure 8:
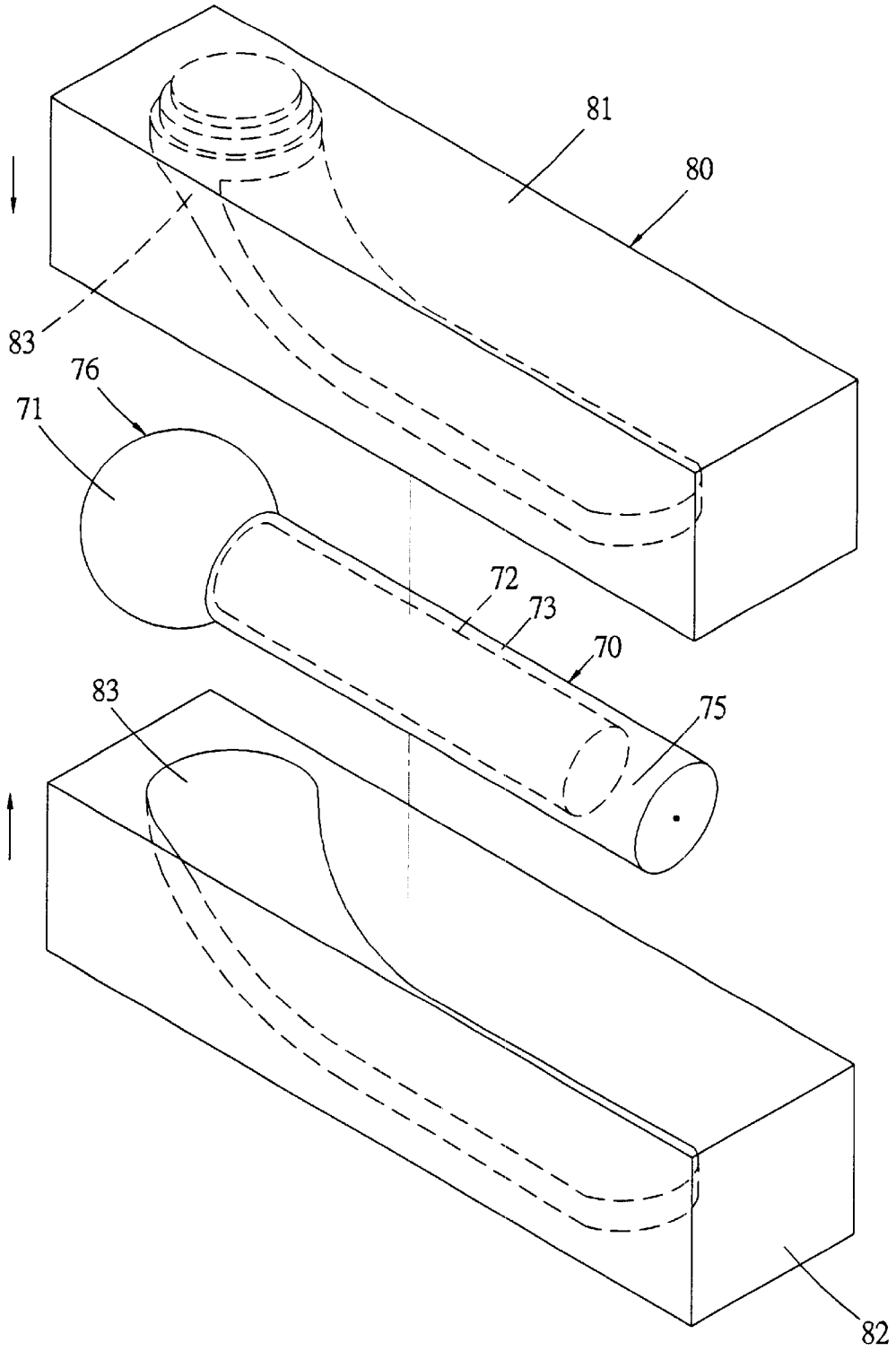
FIG. 8 is an exploded perspective view of the roughly-shaped metal bar material placed in a press mold in the second preferred embodiment in the present invention.

A second preferred embodiment of the method for manufacturing metal material of a bike crank with an intermediate hollow and two solid end portions in the present invention, as shown in FIGS. 7(A) and 7(B), includes a mold 50 with an inner spherical or block-shape hollow 51 for forming a first sold end section 71 of a metal bar material with an intermediate cylindrical hollow 72, and a conical portion 74 formed in one end. Next, the roughly-shaped metal material 70 is placed in the closed mold 50 with the outer open hole 53 to match with the column-shaped press rod 55, and a molding wall 56 is provided near the open hole 53 of the bar body 52, as shown in FIG. 7(B). When the press rod 55 presses the roughly-shaped metal material 70, the expanded conical portion 74 of the metal material 70 is compressed by the molding wall 56, and shrunk to a column-shape to form a second solid end portion 75 with the open hole 53 closed up, as shown in FIG. 8. Thus, a metal material crank 76 with an intermediate hollow 72 and two solid end portions 71 is obtained.

Figure 9:
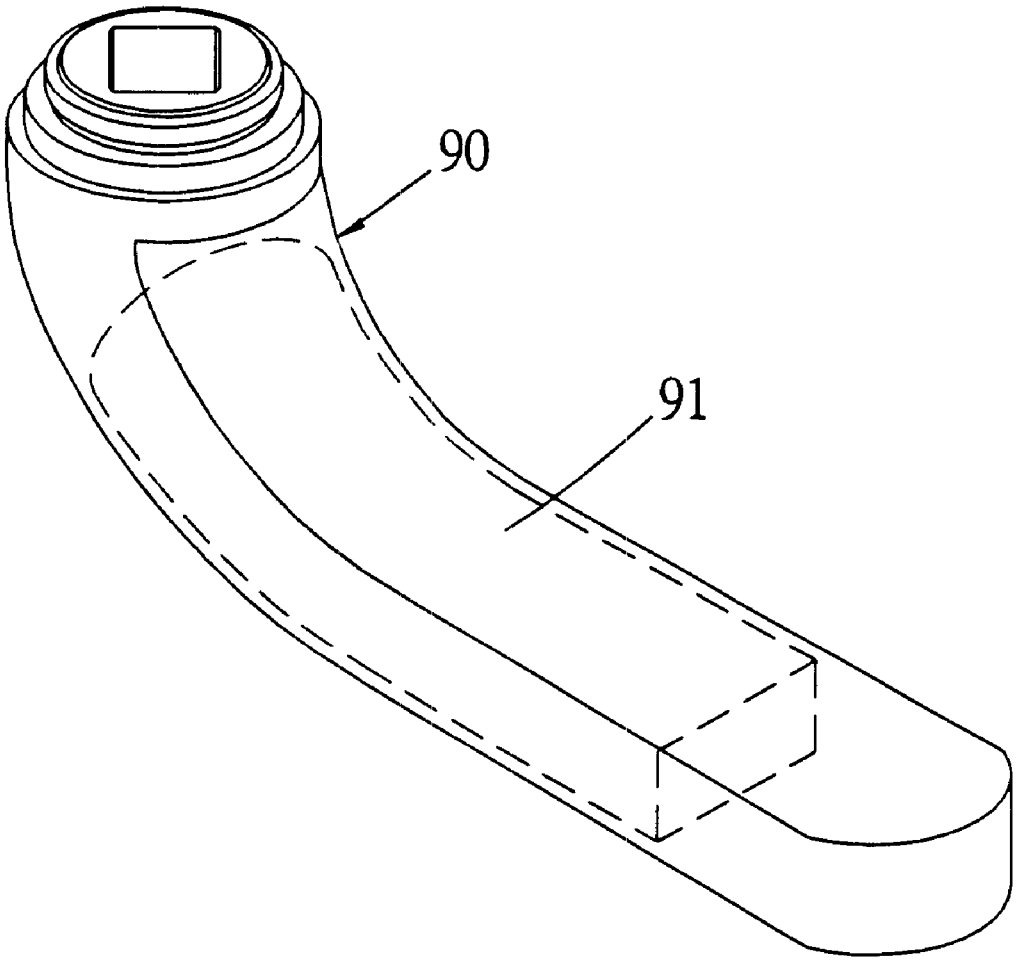
FIG. 9 is a perspective view of a bike crank formed in the method in the present invention.

Lastly, the metal material crank 76 with the first solid end portion 71 and the second solid end portion 75 is placed in a press-mold 80 to be shaped finally as a finished product. The press mold 80 consists of an upper mold 81 and a lower mold 82, having in its central portion a hollow 83 shaped as a bike crank, and the roughly-shaped metal material 70 is compressed and shaped by the press mold 80, as shown in FIG. 9, and, then, a finished product of a bike crank 90 with an intermediate hollow 91 is manufactured.

The technological feature of the method in the invention is a first step of making the roughly-shaped metal material 40 having a first solid end portion 41, a bar body 43 connected with the first solid end portion 41 and having the lengthwise hollow of a preset length. The circumferential wall of the bar body 43 is made integral, and the other end section of the bar body 43 is the opening 45 having the conical portion 45 of the preset size. Next, the conical portion 45 is compressed and shrunk to move towards the open-end portion of the intermediate hollow, and then closed up, forming the second solid end portion 46. Thus, a finished product of metal material with the intermediate hollow and the two solid end portions is manufactured.

While the preferred embodiments of the invention have been described above, it will be recognized and understood that various modifications may be made therein and the appended claims are intended to cover all such modifications that may fall within the spirit and scope of the invention.

I claim:

1. A method of manufacturing a bicycle crank having a hollow center portion and solid end portions, comprising the steps of:

a) providing a blank mold having a mold cavity including a closed end forming a first enlarged chamber, an open end forming a second enlarged chamber and an elongated cylindrical portion interconnecting and communicating with the first and second enlarged chambers, the cylindrical portion having a cross-sectional dimension smaller than the cross-sectional dimensions of the first and second enlarged chambers;

b) placing a solid metal bar in the cylindrical portion of the mold cavity;

c) inserting a first press rod into the solid metal bar through the open end of the mold cavity into at least a portion of the cylindrical portion of the mold cavity, the first press rod having a cross-sectional dimension less than the cross-sectional dimension of the cylindrical portion of the mold cavity, whereby the metal material of the metal bar completely fills the first elongated chamber to form an enlarged first solid end portion, fills a space in the cylindrical portion around the first press rod to form a hollow center portion, and at least partially fills the second enlarged chamber;

d) removing the first press rod from the mold; and, e) inserting a second press rod into the second enlarged cavity, the second press rod having a cross-sectional dimension greater than the cross-sectional dimension of the elongated cylindrical portion of the mold cavity to compress the metal material at least partially filling the second enlarged chamber so as to form a second solid end portion.

2. The method according to claim 1 wherein the second press rod compresses the metal material in the second enlarged chamber thereby forming an enlarged second solid end portion.

3. The method according to claim 1 wherein the second press rod compresses the metal material in the cylindrical portion of the mold cavity to form the second solid end portion.

4. The method according to claim 1 comprising the additional steps of:

a) removing the metal material from the blank mold;

b) providing a bicycle crank mold including upper and lower crank mold portions bounding a curved cavity;

c) placing the metal material in the curved cavity; and, d) pressing the upper and lower mold portions together to form a curved bicycle crank with first and second solid ends and a hollow center portion.

5. The method of claim 4 wherein at least a portion of the hollow center portion is curved.

* * * * *

UNITED STATES PATENT AND TRADEMARK OFFICE
Certificate

Patent No. 6,401,511 B1 Patented: June 11, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Tony Leng, Nan Tou City, Nan Tou Hsien, Taiwan; and Shiu Tzu Lin, Taichung, Taiwan.

Signed and Sealed this Seventh Day of February 2006.

DERRIS H. BANKS
*Supervisory Patent Examiner*
Art Unit 3725